US010682743B2

(12) United States Patent
Smith

(10) Patent No.: US 10,682,743 B2
(45) Date of Patent: Jun. 16, 2020

(54) HAND CLAMP IMPROVEMENT AND ACCESSORY

(71) Applicant: Wade A. Smith, Xenia, OH (US)

(72) Inventor: Wade A. Smith, Xenia, OH (US)

( * ) Notice: Subject to any disclaimer, the term of this patent is extended or adjusted under 35 U.S.C. 154(b) by 150 days.

(21) Appl. No.: 15/818,477

(22) Filed: Nov. 20, 2017

(65) Prior Publication Data

US 2018/0071895 A1 Mar. 15, 2018

Related U.S. Application Data

(62) Division of application No. 15/168,509, filed on May 31, 2016, now Pat. No. 9,821,439.

(60) Provisional application No. 62/290,615, filed on Feb. 3, 2016, provisional application No. 62/308,162, filed on Mar. 14, 2016.

(51) Int. Cl.

| | |
|---|---|
| ***B25B 7/14*** | (2006.01) |
| ***B25B 5/16*** | (2006.01) |
| ***B25B 5/06*** | (2006.01) |
| ***B25B 7/06*** | (2006.01) |

(52) U.S. Cl.

CPC ..... *B25B 7/14* (2013.01); *B25B 5/06* (2013.01); *B25B 5/16* (2013.01); *B25B 5/163* (2013.01); *B25B 7/06* (2013.01)

(58) Field of Classification Search

CPC .. B25B 5/04; B25B 5/16; B25B 5/163; B25B 7/00; B25B 7/02; B25B 7/04; B25B 7/22

See application file for complete search history.

(56) References Cited

U.S. PATENT DOCUMENTS

| | | | | |
|---|---|---|---|---|
| 247,671 | A * | 9/1881 | McKeever | B67B 7/186 81/3.43 |
| 1,435,595 | A * | 11/1922 | Fegely | B25B 1/04 269/239 |
| 3,263,535 | A * | 8/1966 | Zurcher | B25B 5/06 81/302 |
| 3,807,718 | A | 4/1974 | Sendoykas | |
| 4,616,113 | A | 10/1986 | Jank | |
| 5,183,191 | A | 2/1993 | Garrison | |
| 5,765,820 | A | 6/1998 | Marusiak | |
| 6,134,993 | A | 10/2000 | Tally | |
| 6,308,597 | B1 * | 10/2001 | Stahle | B23K 37/04 81/302 |
| 6,336,386 | B1 | 1/2002 | Lee | |
| 6,644,636 | B1 * | 11/2003 | Ryan | B25B 5/06 269/156 |
| 6,860,179 | B2 | 3/2005 | Hopper | |
| 6,976,412 | B1 | 12/2005 | Yu | |
| 6,983,677 | B1 | 1/2006 | Engel | |
| 7,104,166 | B1 | 9/2006 | Wong | |
| 7,107,881 | B1 | 9/2006 | Liou | |
| 7,249,698 | B2 | 7/2007 | Sutton | |
| 8,087,137 | B2 | 1/2012 | Wang | |
| 8,137,379 | B2 | 3/2012 | Labash | |

(Continued)

OTHER PUBLICATIONS

Clamp Provides Extra Hand by Gripping Work Firmly, Popular Mechanics, Jan. 1942, p. 40.

*Primary Examiner* — Tyrone V Hall, Jr.

(74) *Attorney, Agent, or Firm* — Bergman LLC; Michael Bergman

(57) ABSTRACT

A spring clamp for assembly fixturing includes a retainer that limits a minimum distance between jaws of the spring clamp when the spring clamp is in a relaxed state.

19 Claims, 12 Drawing Sheets

(56) References Cited

U.S. PATENT DOCUMENTS

| | | | | |
|---|---|---|---|---|
| 8,555,754 | B2 | 10/2013 | Chen | |
| 8,740,208 | B2 | 6/2014 | Hagan | |
| 8,783,671 | B2 * | 7/2014 | Ranieri | B25B 5/04 269/207 |
| 9,027,913 | B2 | 5/2015 | Li | |
| 9,180,556 | B2 | 11/2015 | Huang | |
| 9,254,555 | B2 | 2/2016 | Hagan | |
| 9,339,939 | B1 | 5/2016 | Haney | |
| 2003/0005797 | A1 | 1/2003 | Hopper | |
| 2005/0160567 | A1 | 7/2005 | Liou | |
| 2005/0260973 | A1 | 11/2005 | van de Groenendaal | |
| 2006/0208407 | A1 | 9/2006 | Wang | |
| 2006/0284359 | A1 * | 12/2006 | Healy | B23K 37/0435 269/238 |
| 2009/0199682 | A1 | 8/2009 | Hanning | |
| 2010/0314816 | A1 | 12/2010 | Yang | |
| 2011/0175270 | A1 | 7/2011 | Hagan | |
| 2012/0137840 | A1 | 6/2012 | Chen | |
| 2012/0211932 | A1 | 8/2012 | Liou | |
| 2014/0230198 | A1 | 8/2014 | Hagan | |
| 2015/0008631 | A1 | 1/2015 | Liu | |
| 2015/0059537 | A1 | 3/2015 | Chen | |
| 2015/0075335 | A1 | 3/2015 | Zheng | |

* cited by examiner

HAND CLAMP IMPROVEMENT AND ACCESSORY

CROSS-REFERENCE TO RELATED APPLICATIONS

The present application is a divisional of U.S. patent application Ser. No. 15/168,509 filed on May 31, 2016 (now issued as U.S. Pat. No. 9,821,439), which in turn claims the benefit of U.S. provisional patent application No. 62/290,615 filed on Feb. 3, 2016, and of U.S. provisional patent application 62/308,162 filed on Mar. 14, 2016, the disclosures of all of the foregoing are incorporated by reference in their entireties in the present application.

FIELD OF THE INVENTION

This invention relates to the field of manufacturing tools and more particularly to fixturing tools for material clamping.

SUMMARY

Efficiency and value are essential goals in manufacturing. The ability to produce a product while optimizing the balance between input costs and output value is a hallmark of successful production. Any improvement that reduces inputs, without diminishing the value of the product has the potential to yield significant benefits for a manufacturing operation.

One important input cost to most manufacturing operations is labor, quantified in units of worker time. Increasing the number of production steps that a worker can complete in a given amount of time reduces the labor input, and consequently the labor cost, for the product addressed.

Having examined and understood a range of previously available devices, the inventor of the present invention has developed a new and important understanding of the problems associated with the prior art and, out of this novel understanding, has developed new and useful solutions and improved devices, including solutions and devices yielding surprising and beneficial results. The invention encompassing these new and useful solutions and improved devices is described below in its various aspects with reference to several exemplary embodiments including a preferred embodiment.

The following description is provided to enable any person skilled in the art to make and use the disclosed invention and sets forth the best modes presently contemplated by the inventor of carrying out his invention. In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in schematic form in order to avoid unnecessarily obscuring the substance disclosed. The foregoing and other advantages and features of the invention will be more readily understood in relation to the following detailed description of the invention, which is provided in conjunction with the accompanying drawings.

It should be noted that, while the various figures show respective aspects of the invention, no one figure is necessarily intended to show the entire invention. Rather, the figures together illustrate the invention in its various aspects and principles. As such, it should not be presumed that any particular figure is exclusively related to a discrete aspect or species of the invention. To the contrary, one of skill in the art will appreciate that the figures taken together reflect various embodiments exemplifying the invention.

Correspondingly, reference throughout the specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

DETAILED DESCRIPTION

Figure 1:
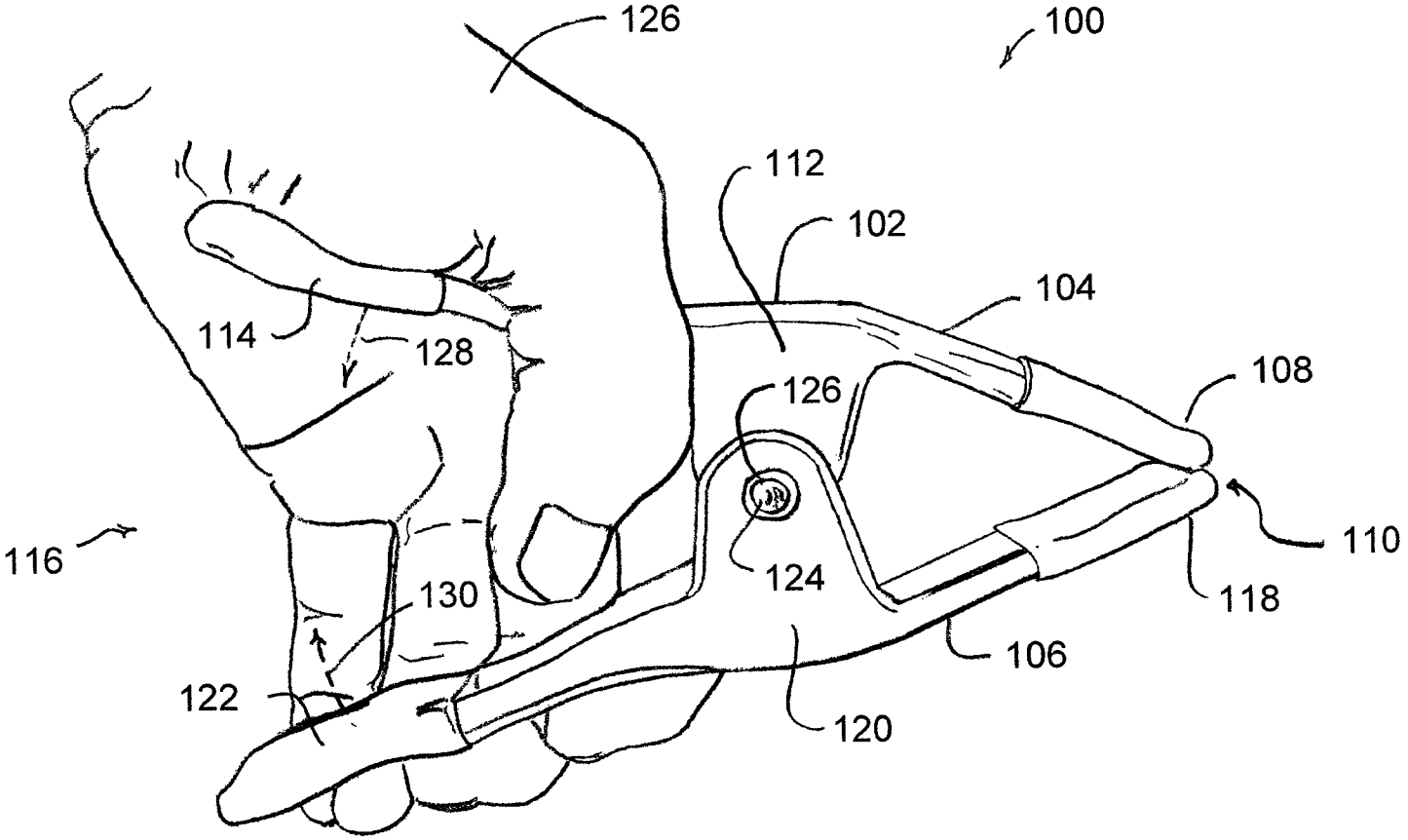
FIG. 1 shows, in perspective view, a spring clamp and illustrates certain aspects of its method of use.

FIG. 1 shows, in perspective view 100, a typical spring clamp 102 well adapted for use with certain embodiments of the invention. The spring clamp 102 includes a first lever portion 104 and a second lever portion 106. The first lever portion 104 includes a jaw region 108 at a distal end 110 of the spring clamp 102, a pivot flange region 112 at a medial location of said first lever portion, a further pivot flange region (not visible) and a handle region 114 at a proximal end 116 of the spring clamp. In like fashion, the second lever portion 106 includes a jaw region 118 at distal end 110, a pivot flange region 120 at a medial location of said first lever portion, a further pivot flange region (not visible), and a handle region 122 at the proximal end 116.

Each of the flange regions, 112, 120 (and those not shown) includes a transverse bore, through which is mutually disposed a shaft 124. Shaft 124 serves as a fulcrum for pivotal operation of the spring clamp 102. When a user's hand 126 applies compressive forces inwardly 128, 130 against the handle regions 114, 122. As is well known in the art, shaft 124 will embody one or more detent features to maintain its transverse location with respect to the flange portions. Accordingly, in the illustrated example, a peened or forged head 126 of the shaft serves to maintain the shaft in place by a rotatable coupling to the flange regions.

Figure 2:
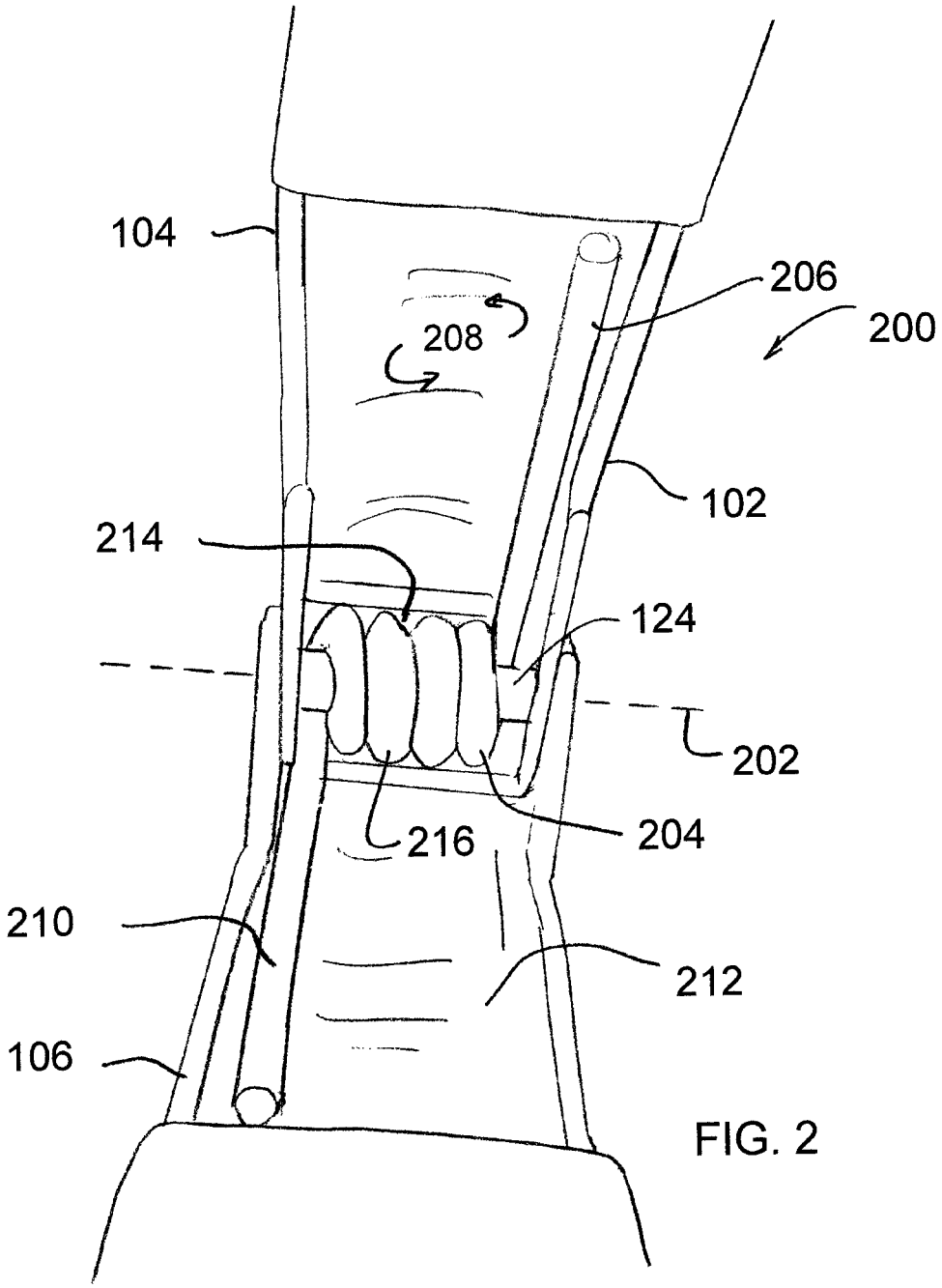
FIG. 2 shows, in perspective view, a further aspect of a spring clamp like that of FIG. 1.

FIG. 2 shows another aspect of spring clamp 102 in perspective view 200. In this view, the longitudinal extent, along longitudinal axis 202, of shaft 124 is visible, and is shown supporting helical spring 204. A first end region 206 of spring 204 extends along, and in contact with, a surface region 208 of first lever portion 104. A second end region 200 of spring 204 extends along, and in contact with, a surface region 212 of second lever portion 106. It will be noted that a plurality of circumferential surface regions of spring 204 together constitute a generally cylindrical external surface 214 of a helical portion 216 of spring 204.

In operation, forces applied by a user's hand to lever portions 104 and 106 are conveyed through surface regions 208 and 212 to the end regions 206, 210 of the helical spring 204. This results in an elastic deformation of the spring 204, including helical portion 216, which, because of the elastic nature of the spring, serves to oppose the applied forces.

Figure 3A:
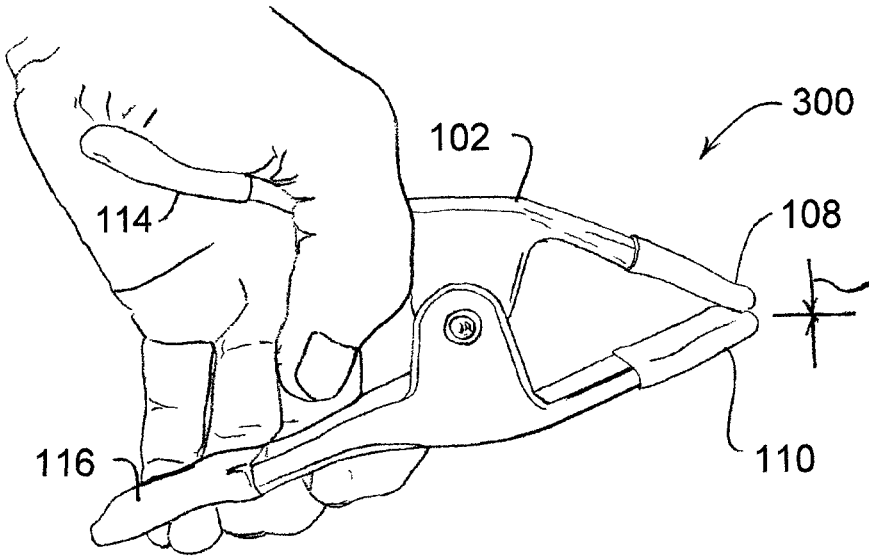
FIGS. 3A-3C show a spring clamp and method of operation as in FIG. 1 in a first, a second and a third state, respectively.
Figure 3B:
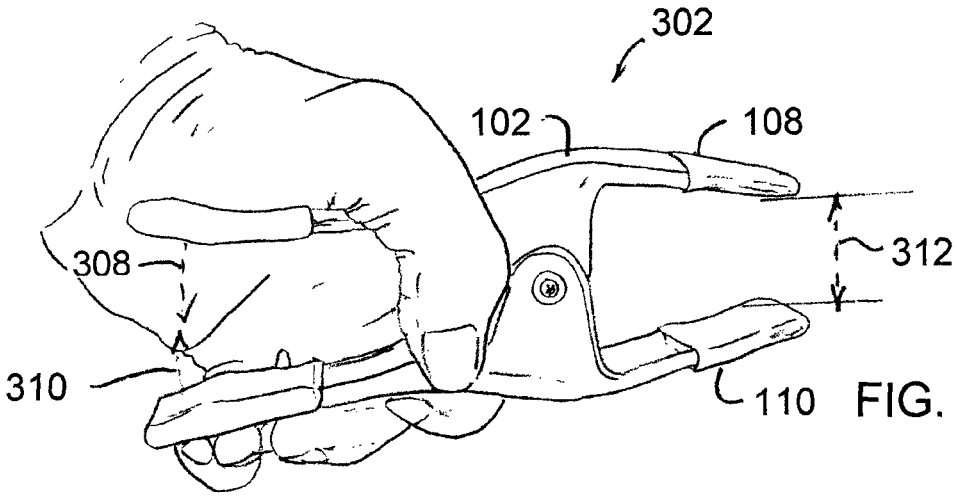
Figure 3C:
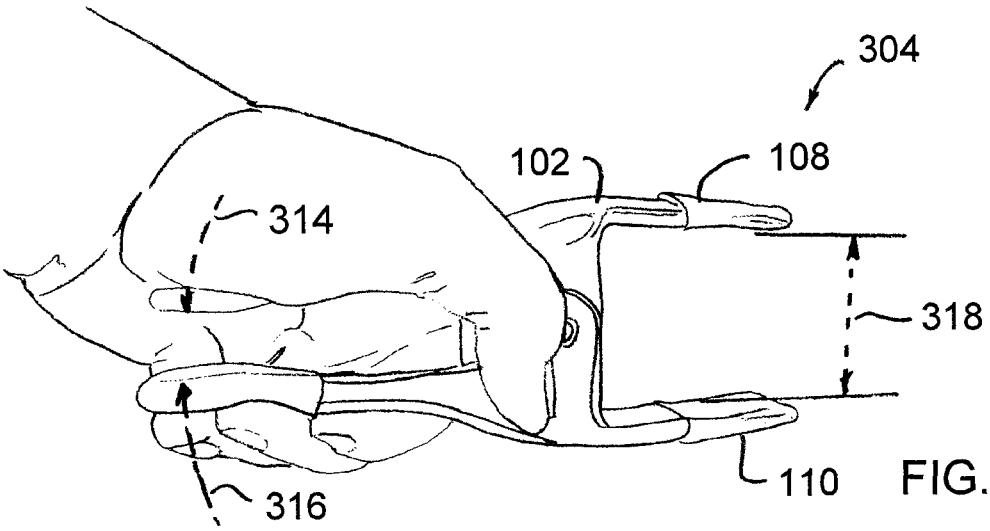

FIGS. 3A-3C show, in respective perspective views, three corresponding exemplary states 300, 302, 304 of operation of the spring clamp 102 of FIG. 1. FIG. 3A shows spring clamp 102 in a relaxed state 300 where essentially no compressive forces are applied by the user's hand to the handle regions 114, 116. Consequently, a distance 306 measured between distal ends of the jaw regions, 108, 110 is essentially zero (i.e., the jaws are closed).

FIG. 3B shows spring clamp 102 in a moderately activated state 304 in which intermediate compressive forces 308, 310 are applied by the user to handle regions 114, 116, resulting in a corresponding displacement of the handle regions. The result is a displacement of the jaw regions 108, 110 to an intermediate distance 312.

FIG. 3C shows spring clamp 102 in a fully activated state 306 in which maximal compressive forces 314, 316 are applied by the user to handle regions 114, 116, resulting in a corresponding displacement of the handle regions. The result is a displacement of the jaw regions 108, 110 to a maximum distance 318.

One of skill in the art will appreciate that substantial forces must be applied to clamp 102 to effect the transitions from state 300 to state 302, and from state 302 to state 304. This application of forces, over the corresponding mutual displacement of the handle portions 114, 116 results in the storage of energy in the helical spring 204 shown in FIG. 2. In the case of a typical spring clamp 102 this application of forces, and the resulting expenditure of energy, as made within a single operative cycle of the clamp, is well within the capabilities of a typical user.

Many industrial and other operations, however, involve not the application of a single spring clamp, but the application of multiple clamps. In some cases dozens or even hundreds of clamps are applied to a particular workpiece in the course of, for example, a gluing operation, a welding operation, or some other operation in which temporary positioning and fixturing of workpieces is desirable. In such circumstances, the energy expended by a worker in the application of these multiple clamps amounts over the many cycles associated with those clamps, to a substantial portion of the worker's available energy. Naturally, as the worker performs this work, he or she tends to tire and, consequently, to complete the application of successive clamps in progressively slower fashion.

As previously noted, spring clamps have been in use for many years, and such tiring of a worker with the application of multiple clamps is a well-known phenomenon. Various approaches have been taken to solving this well-known problem, none of them achieving the benefits of the invention disclosed herewith. For example, C-clamps have long been used in clamping operations. As is known in the art, C-clamps employ a threaded screw to urge a mobile jaw element towards a fixed jaw element within a C-shaped frame. A C-clamp does not provide the same clamping characteristics as the spring clamp of the present invention. While turning the threaded screw may require less input force for a given level of intra-jaw compression, a relatively large number of motions are required to traverse a comparable jaw displacement, and because very high forces are available, there is a possibility of damage to the workpiece being addressed.

Likewise, pliers-style clamps have been prepared employing handles that apply lever forces to jaws transversely across a pivotal fulcrum shaft. In such pliers-style clamps, a unidirectional frictional detent mechanism is provided to maintain the jaws at a substantially fixed location once maximum compression has been achieved by the application of forces to the handle portions. One of skill in the art will appreciate, however, that these forces are maintained against a workpiece by the elasticity of the jaw members themselves, rather than by the discrete helical spring of the present invention. Consequently, like the C-clamp, the force curve of the pliers-style clamp tends to rise abruptly. Thus, use of the pliers-style clamp can readily result in damage to a workpiece to which it is applied.

In considering these characteristics of the prior art, and the nature of the work to be done, the inventor has arrived at a new appreciation of the costs of the previously applied modes of operation, and has developed new and important additional features that advance the existing technology. The result is a clamping device that provides the best features of the existing spring clamp technology, while significantly reducing the energy required for clamp application. The result is a new clamping method and apparatus that, as compared with the prior art, can be readily applied by a worker with reduced fatigue, a minimization of the potential for worker injury, a reduced probability of damaging the workpiece, and an opportunity to do more work in less time.

Specifically, and as herewith disclosed, for the fixturing of a workpiece having a dimension close to dimension 312 of 3B, the energy applied in bringing a spring clamp 102 from state 300 to state 302 represents an input that can be avoided if spring clamp 102 is limited in its range of motion to states between and including 302 and 304. That is, on a cumulative basis, there is a substantial reduction in worker effort to be had if the spring clamp does not default to state 300, but, when released by the user, and not applied to any workpiece, the spring clamp 102 enters state 302 (i.e., with jaw opening dimension 312), and does not return to state 300.

Figure 4A:
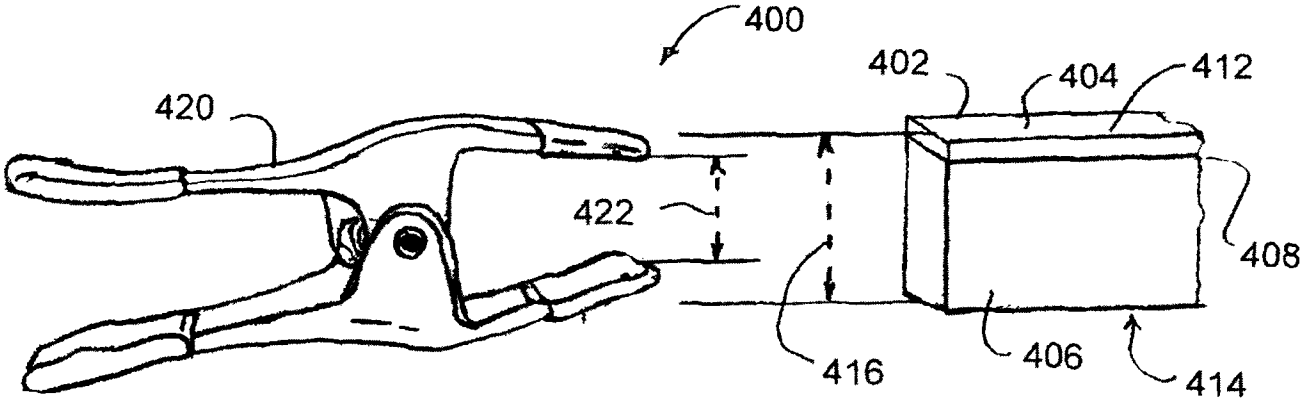
FIGS. 4A and 4B show, respectively, a spring clamp in relation to, and in contact with a multi-part workpiece.
Figure 4B:
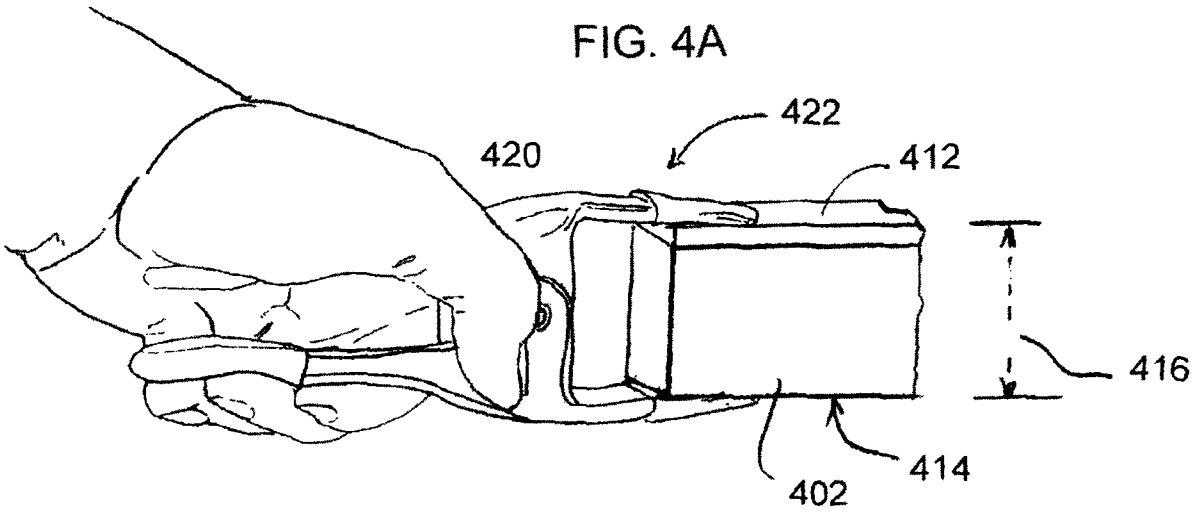

FIGS. 4A-4B illustrate the posited circumstances 400 with respect to an exemplary workpiece 402. Workpiece 402 includes a first member 404 and a second member 406. An adhesive material 408 is disposed between the first member and the second member. Accordingly, an assembly 410 includes the first member 404, the adhesive material 408, and the second member 406. A first external surface 412 of the first member 404 is disposed in substantially parallel spaced relation to a second external surface 414 (not visible) of the second member 406, such that an outside dimension 416 of the assembly 410 forming workpiece 402 has a substantially fixed value.

Referring again to FIG. 3A, applying a typical spring clamp to the assembly 410 would require activating the spring clamp 102 to expand jaws 108 and 110, from an initial state 300 in which the space between the jaws has a value substantially equal to zero, to a second value equal to at least the outside dimension 416 of the workpiece 402.

If, however, as shown in FIG. 4A, a spring clamp 420 is provided, having an initial jaw opening 422 that is slightly smaller than the outside dimension 416 of the assembly 410, only a small additional activation is required to expand the spring clamp jaws 424, 426 to a value equivalent to outside dimension 416 of the workpiece 402. As shown in FIG. 4B, once the spring clamp 420 has achieved this state 400, its jaws can be applied to the external surfaces 412, 414 of the workpiece 402 respectively, applying corresponding forces to the workpiece 402 as a whole.

One of skill in the art will appreciate that the elastic characteristic of the spring of a spring clamp will generally at least approximately follow Hook's law. Accordingly, the forces applied will generally be different in the case in which a spring of the spring clamp 420 is configured to have a resting state corresponding to state 400 as opposed to a resting state 300 as shown in FIG. 3A. Generally speaking, for given spring dimensions, the forces applied to the workpiece 402 will be substantially higher if the rest state of the spring clamp is state 300, rather than state 420. Recognizing, however, that a worker's energy applied to the spring clamp to effect a transition from state 300 to state 400 is not recoverable, and effectively wasted, the present invention provides a spring with a relaxed configuration corresponding to state 300, but with a spring clamp arranged to return only to state 400 when released.

The savings in worker energy resulting from not having to force a spring clamp between states 300 and 400 are cumulative, and amount to a substantial reduction in worker exertion over repetitive application of a spring clamp according to the invention. With this in mind, various exemplary details and configurations are now provided for producing a spring clamp with this characteristic.

Figure 5A:
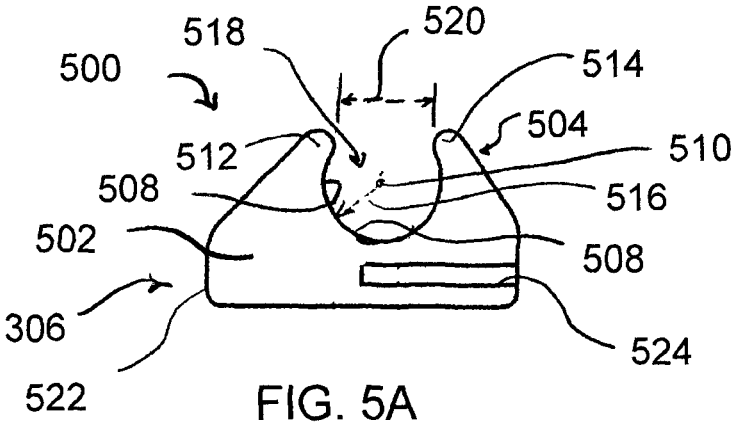
FIGS. 5A-5E show respective aspects of a spring clamp speed block feature prepared according to principles of the invention.

FIGS. 5A-5E illustrate one exemplary embodiment of the invention in which a retainer or speed block is provided as an accessory for a conventional spring clamp. FIG. 5A shows the speed block 500 in side elevation view. The speed block includes a body member 502 including a clip region 504 and an interference region 506.

Clip region 504 includes an internal surface region 508 disposed in an arcuate configuration. In certain embodiments, the arcuate surface region 508 will include a portion of a substantially circular cylindrical surface defined about a longitudinal axis 510. In alternative embodiments, the arcuate surface region 508 will include a portion of a substantially elliptical cylindrical surface defined about two longitudinal axes at respective elliptical foci. In still other embodiments, the internal surface region will approximate a polygonal cylindrical surface such as, for example, a triangular cylindrical surface, a rectangular cylindrical surface, a pentagonal cylindrical surface, a hexagonal cylindrical surface, and so on. In still other embodiments the internal surface region will be irregular but nevertheless function as further described herewith.

The body member 502 includes at least a first protruding portion 512 and a second protruding portion 514 which together serve to extend the surface region 508 beyond 180° around longitudinal axis 510. Radius 516 of the surface region 508 is chosen to closely accommodate an outer surface of a helical spring clamp spring (like that shown 214 in FIG. 2). Consequently, while a spring clamp helical spring can be disposed within a recess 518 defined by, and disposed inwardly of, the surface region 508, a distance 520 between the first 512 and second 514 protruding portions is insufficient to allow the helical spring to be inadvertently removed from the recess.

The interference region 506 includes an external surface region 522 at one end thereof, and a further recess 524 into the other end thereof. As will be further explained below, this further recess 524, configured as a bore in certain embodiments, is sized and arrange to accommodate an adjusting member.

Figure 5B:
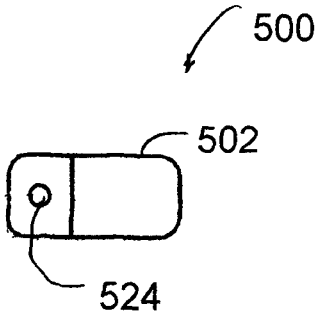

FIG. 5B shows a side view of the body member 502 of the speed block 500. The further recess 524 of the exemplary speed block 500 is seen to have a substantially circular circumferential edge.

Figure 5C:
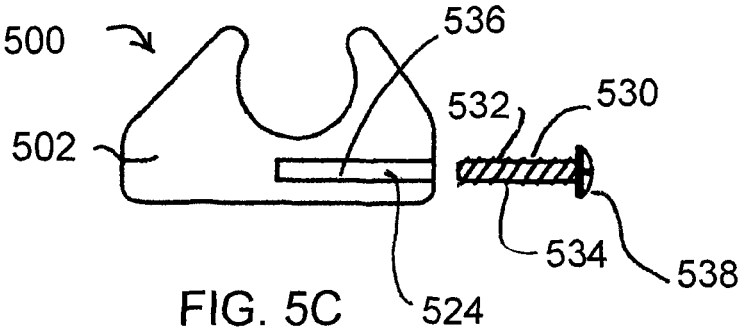

FIG. 5C shows, in cross-sectional view, a further aspect of speed block 500, including body member 502, and an adjusting member 530. In the illustrated example, the adjusting member 530 includes a screw, such as a machine screw, having an external surface 532 bearing external helical threads 534. One of skill in the art will understand that further recess 524 will be configured to include a corresponding internally threaded surface 536.

The adjusting member 530 includes an adjusting feature configured to control its spatial relationship to the body member 502. Thus, for example, the illustrated machine screw includes a slotted head 538, adapted to receive a portion of a straight blade screwdriver therewithin. One of skill in the art, having been presented with the foregoing disclosure, will readily appreciate that other configurations of adjustment mechanism are also intended to fall within the present disclosure including, for example and without limitation, a hexagonal head, a recessed cap-screw head, a recessed Phillips head, a recessed hexagonal setscrew head, a square head, or any other configuration or feature appropriate for adjustment of the adjusting member 530 with respect to the body member 502.

Figure 5D:
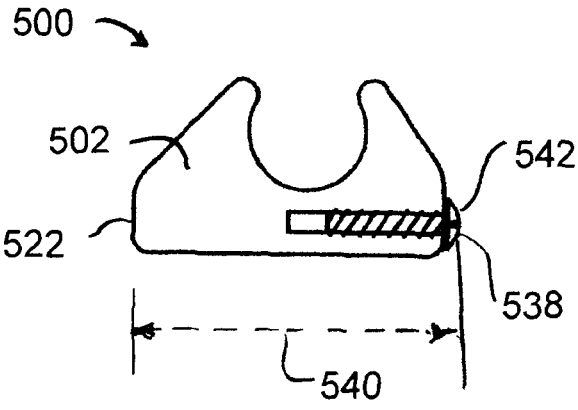
Figure 5E:
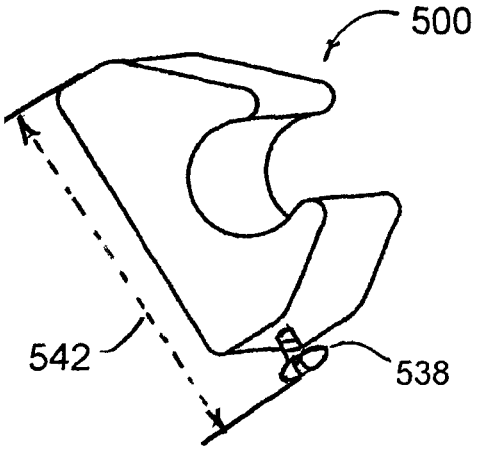

FIG. 5D shows an exemplary speed block 500 including body member 502 and adjusting member 530. As illustrated, the adjusting member 530 is fully inserted into the further recess 524, such that the speed block defines a minimum interference distance 540 between external surface region 522 and a distal end of slotted head 538. One of skill in the art will readily appreciate that by rotation of the slotted head 538, the adjusting member 530 will be advanced outwardly from the further recess 524, thereby adjusting and increasing the length of interference distance 540. Accordingly, FIG. 5E shows, in schematic perspective view, speed block 500, where adjusting member 538 has been rotated to adopt a partially extended position. Consequently, the interference distance 542 shown in FIG. 5E is longer than interference distance 540 shown in FIG. 5D.

Figure 6:
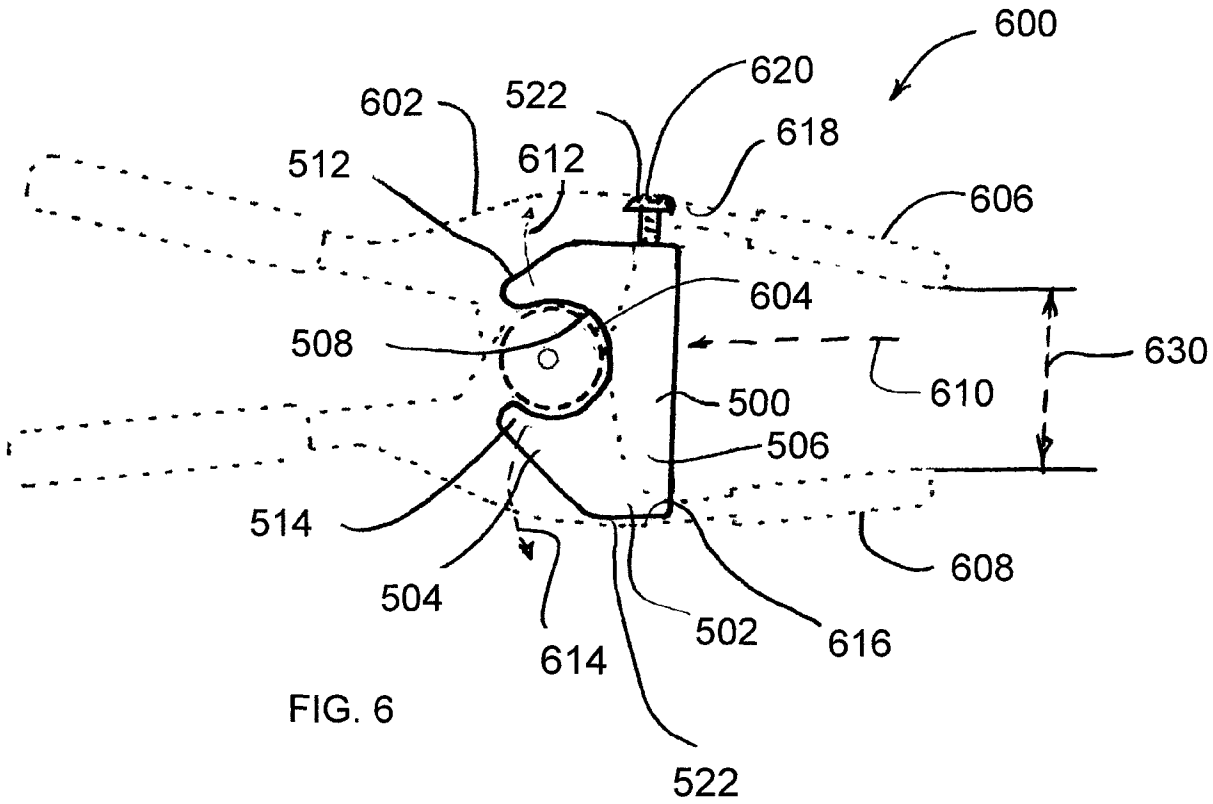
FIG. 6 illustrates an operative spatial relationship between components of a spring clamp prepared according to principles of the invention.

FIG. 6 shows, in schematic side elevation 600, an exemplary speed block 500 installed in a spring clamp 602. Spring clamp 602 is shown in dashed lines for clarity of presentation. As previously described, the speed block 500 includes a body member 502 with a clip region 504 and interference region 506. The internal surface region 508 of the clip region 504 is disposed around, and generally in contact with, an external generally cylindrical surface region 604 of the helical spring that urges the jaws 606, 608 of the spring clamp 602 closed. As will be apparent to the reader, protruding portions of the speed block 512, 514 serve to partially encircle the surface region of the helical spring 604 so that an interference between internal surface region 508 of the speed block, and external surface region 604 of the helical spring, tends to retain the speed block 500 in position within the spring clamp 602.

One of skill in the art will appreciate that including a material having appropriate elastic characteristic in the speed block 500 will allow the protruding portions 512, 514 to exhibit a limited degree of elastic flexibility. This will permit installation of the speed block 500 within the spring clamp 602 by opening the jaws of the spring clamp and pressing the speed block 500 inward in direction 610, so that the protruding portions 512, 514 deflect temporarily outwardly 612, 614. As the speed block 500 reaches its destination within the spring clamp 602, elastic forces within the elastic material of the speed block tend to return the protruding portions 512, 514 in the opposite direction so as to partially encircle the helical spring outer surface 604 and thereby clip the speed block in place.

Thereafter, releasing the handles of the spring clamp 602 allows an internal surface region 616 of jaw 608 of the spring clamp to come into contact with an external surface region 522 at the interference region of the speed block 500. Likewise, an internal surface region 618 of the other jaw 606 comes into contact with an upper surface region 620 of the adjusting member 522 (here exemplified as a machine screw).

In light of the present disclosure, one of skill in the art will readily understand that these mutual contacts will result in an interference between the surface regions, such that, allowing for any deflection characteristic of the interference region of the speed block, the jaws of the spring clamp 602 will only close to a minimum distance 630 that is primarily a function of the distance between surface regions 522 and 620. The skilled reader will also understand that this distance will be adjustable by manipulation of the adjustment member 522. Moreover, as previously discussed, the illustrated speed block will in no way interfere with the further operation of the spring clamp 602 so as to open the jaws 606, 608 wider than distance 632 allow the insertion of a workpiece therebetween.

It will further be appreciated by the reader of skill in the art that, assuming a workpiece having an outside dimension slightly larger than distance 630, the force exerted inwardly by the jaws 606, 608 on the workpiece when the handles of the spring clamp 602 are released, will be substantially identical to the force exerted on the workpiece by the jaws had the spring clamp been opened from an original state in which the jaws were fully closed. That is, the disposition of the illustrated speed block 500 within the spring clamp 602, will result in an assembly having the characteristics discussed above in relation to FIGS. 4A and 4B.

Figure 7A:
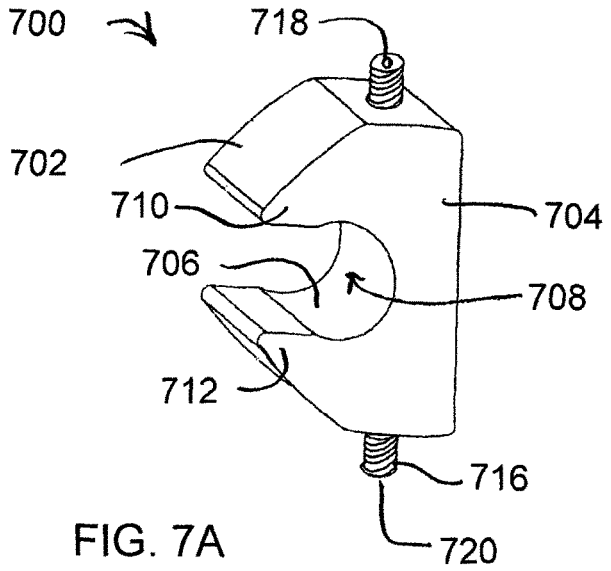
FIGS. 7A-7C illustrate, respectively, aspects of a spring clamp including a speed block and a method of using the same.

FIG. 7A shows, in schematic perspective view, a further exemplary speed block 700 prepared according to principles of the invention. Like speed block 500, described above, speed block 700 includes a clip portion 702 and an interference portion 704. The clip portion includes an internal surface region 706 defining a recess 708. The recess is sized and configured to accommodate a portion of a helical spring of a spring clamp. First 710 and second 712 protrusions include a flexible or deformable material and are configured to be disposed far enough around a circumferential surface of the helical spring to substantially fixedly retain the speed block within the spring clamp.

In contrast to speed block 500, the interference portion 704 of speed block 700 includes two adjustment members 714 and 716. In certain embodiments of the invention, these two adjustment members are discrete and independently threaded into respective recesses or bores of the speed block 700. Respective distal ends 718, 720 of the adjustment members exhibit surface regions that, in operation, contact respective internal surface regions of the spring clamp and consequently limit a range of motion inwardly of the spring clamp jaws.

Figure 7B:
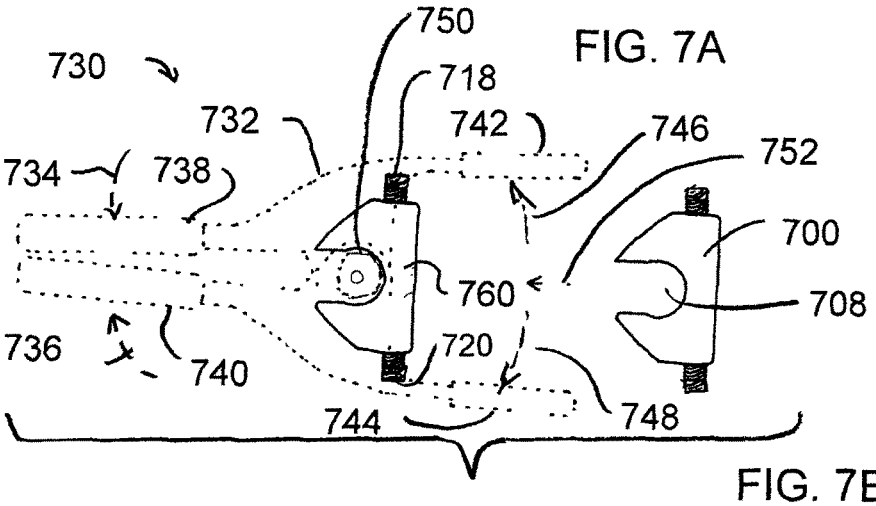

FIG. 7B illustrates 730 a method for installing a speed block (e.g., speed block 700) in a spring clamp 732. As indicated, forces 734, 736 are applied to handles 738, 740 of the spring clamp 732 so as to fully deflect the handles towards one another. Consequently, the jaws 742, 744 of the spring clamp 732 are rotated 746, 748 with respect to one another into the fully opened configuration represented in FIG. 7B.

Thereafter, speed block 700 is aligned so that a longitudinal axis of recess 708 is substantially parallel to a corresponding longitudinal axis of the spring clamp helical spring 750, and the speed block 700 is advanced inwardly 752 between the jaws 742, 744, and into the illustrated location 760. Thereafter, the handles 738, 740 are released, and the distal surfaces 718, 720 of the adjustment members contact corresponding internal surface regions of the jaws 742, 744 to prevent complete closure of those jaws.

Figure 7C:
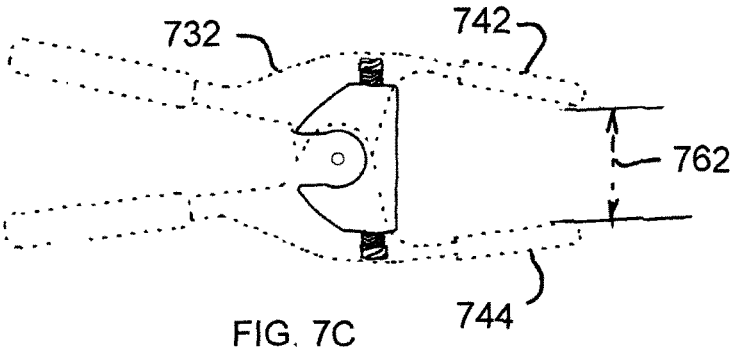

The result, as shown in FIG. 7C is that spring clamp 732, when no longer subject to external forces, resumes a state in which the two jaws 742, 744 have the indicated minimum separation distance 762.

While the speed blocks referred to above have been described in terms of having substantially flexible clip regions, one of skill in the art will also appreciate that alternate embodiments will include other methods of coupling an apparatus providing the function of the interference portion within the spring clamp. Thus, in certain embodiments, the protrusions will include a malleable material such as, for example, a metallic material. In an initial state, the protrusions will be configured to allow passage of a helical spring into a corresponding recess and, thereafter, the protrusions will be bent, peened, forged, or otherwise deformed to angularly advance the protrusions about the helical spring so as to generally fix the speed block adjacent to the helical spring within the spring clamp.

In still other embodiments, the protrusions will include a material having a state that can be altered through chemical or thermal means. Thus, in certain embodiments, a thermoplastic or thermoset polymer will be employed such that, by heating the protrusions, they can be made readily deformable so as to capture the spring of a spring clamp. Thereafter, once the protrusions are cool, they become more or less permanently fixed in this configuration so as to maintain the spring clamp in substantially permanent captivity.

In still further embodiments, a strap, a band, a zip tie, a radiator clamp, or any other appropriate device, such as is known or becomes known in the art, will be used to couple an interference portion within a spring clamp.

In still other embodiments, adhesive or fastening means will be employed to couple one end of an interference portion substantially fixedly to one jaw of a spring clamp, allowing the other end of the interference portion to move in and out of contact with a corresponding internal surface region of an opposite jaw. One of skill in the art will readily appreciate that such a coupling between the interference portion and the first jaw will be effected, in respective embodiments, with any fastener or fastening mechanism that is known, or becomes known in the art. Such fastening mechanisms will include, without limitation, chemical adhesives, mechanical fasteners such as, for example, screws, nails, rivets, snaps, hook and loop fasteners, and various physical coupling means including, for example, soldering, brazing, and welding including arc welding, spot welding, laser welding, ultrasonic welding, spin welding, pressure welding, or any other effective bonding mechanism.

Figure 8A:
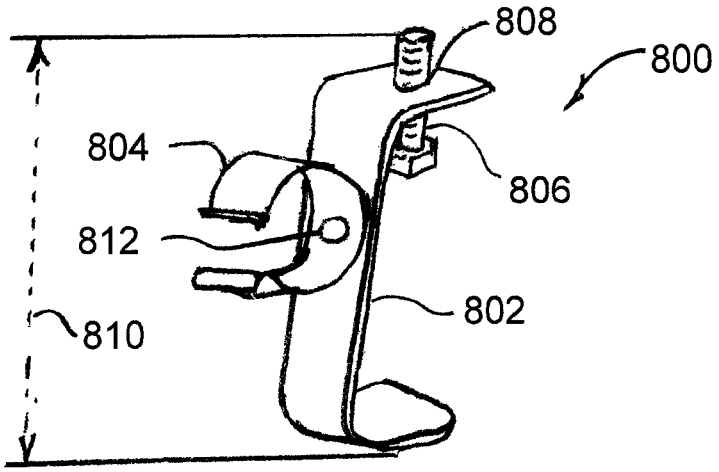
FIGS. 8A and 8B illustrate respective exemplary configurations of a speed block through a spring clamp prepared according to principles of the invention.

Additionally, it will be appreciated that, while the heretofore illustrated speed blocks might have been prepared, by casting, injection molding, forging, drop forging, machining, or other appropriate technologies, to exhibit a body member having the aspect of a substantially contiguous geometric prism, other alternatives are intended to fall within the scope of the present disclosure. Thus, for example, FIG. 8A shows a speed block formed as an assembly 800 including an interference region 802 that has a first member 804 formed of, for example, metallic flat stock, and a clip region 804 including a spring steel material. In addition, an externally threaded bolt 806 is shown disposed within an internally threaded bore 808, thereby offering adjustability of an interference dimension 810. In the illustrated example, clip region 804 is coupled to interference region 802 by a mechanical fastener such as, for example, a rivet 812.

Figure 8B:
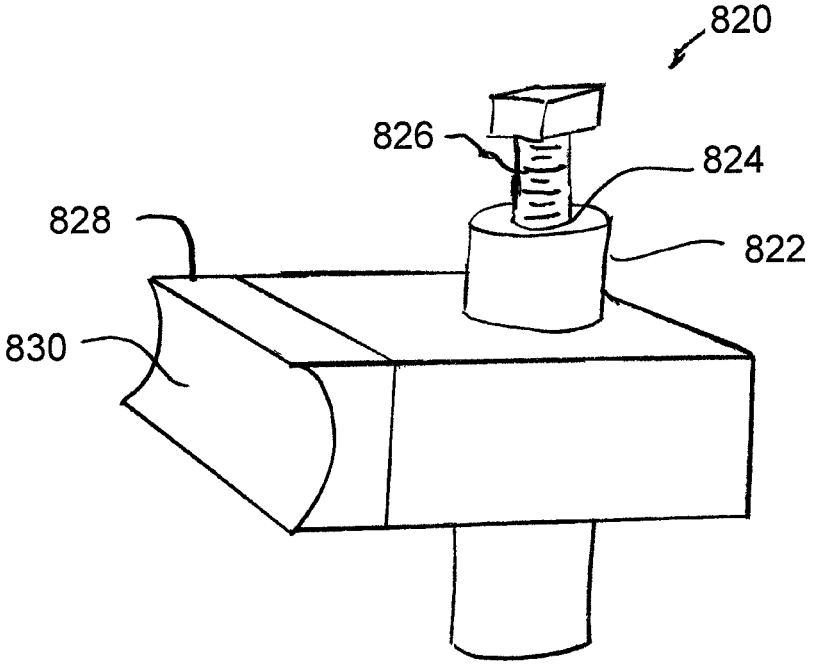

FIG. 8B shows another exemplary device 820 in which an interference region 822 includes, for example, a bar stock portion (here shown, only for purposes of illustration and without any limiting intent, as a substantially circular cylindrical bar stock material. In certain embodiments, the bar stock material will include a metallic material such as, for example, mild steel, however any of a variety of other materials and methods of formation are intended to fall within the scope of the disclosure. An internally threaded bore 824 is provided at one end of the interference region, and an externally threaded bolt or screw 826 is disposed within the internally threaded bore 824 to provide adjustability to the device in the manner described above. In the illustrated example, as in certain other embodiments of the invention, a coupling device such as, for example, a magnet 828 is provided to effect a more or less permanent coupling of the device 820 within a spring clamp (not shown). Thus, for example, an arcuate surface region 830 of magnet 828 is configured for placement in close proximity to a generally cylindrical external surface region of a helical spring of a spring clamp, where the helical spring is anticipated to include a ferrous magnetic material.

Figure 9:
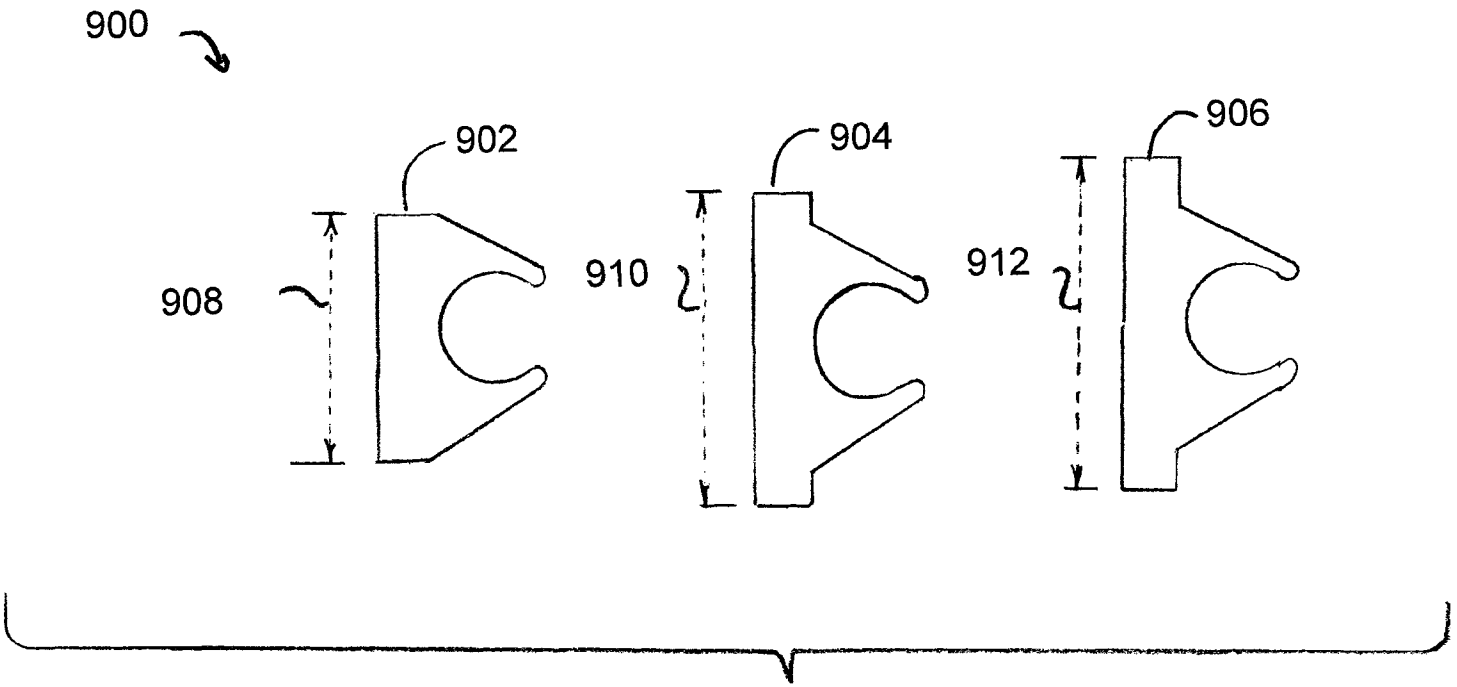
FIG. 9 illustrates an exemplary speed block kit illustrating certain aspects and features of a spring clamp prepared according to principles of the invention.

It will also be appreciated that, in certain embodiments, the invention will include a kit of speed blocks having various respective interference regions of correspondingly different dimensions. Thus, as shown in FIG. 9, an exemplary kit 900 includes three different speed blocks 902, 904, 906, having three different respective interference dimensions 908, 910, 912. A user will select from the kit a speed block having a dimension corresponding to a desired rest dimension of a spring clamp's jaws and install that speed block in the subject spring clamp. Naturally, any number of speed blocks will be included in a kit, according to various considerations including, among others, marketability and ease of production.

It should be understood that the invention is in no way limited to the application of a speed block to a spring clamp, and that a wide variety of other devices and mechanisms that serve to limit and/or adjust and/or control a range of motion of jaws of a spring clamp will fall within the ambit of the invention. Thus, for example, certain spring clamps will be provided that incorporate features serving to constrain a span of jaw motion according to principles of the invention.

Figure 10:
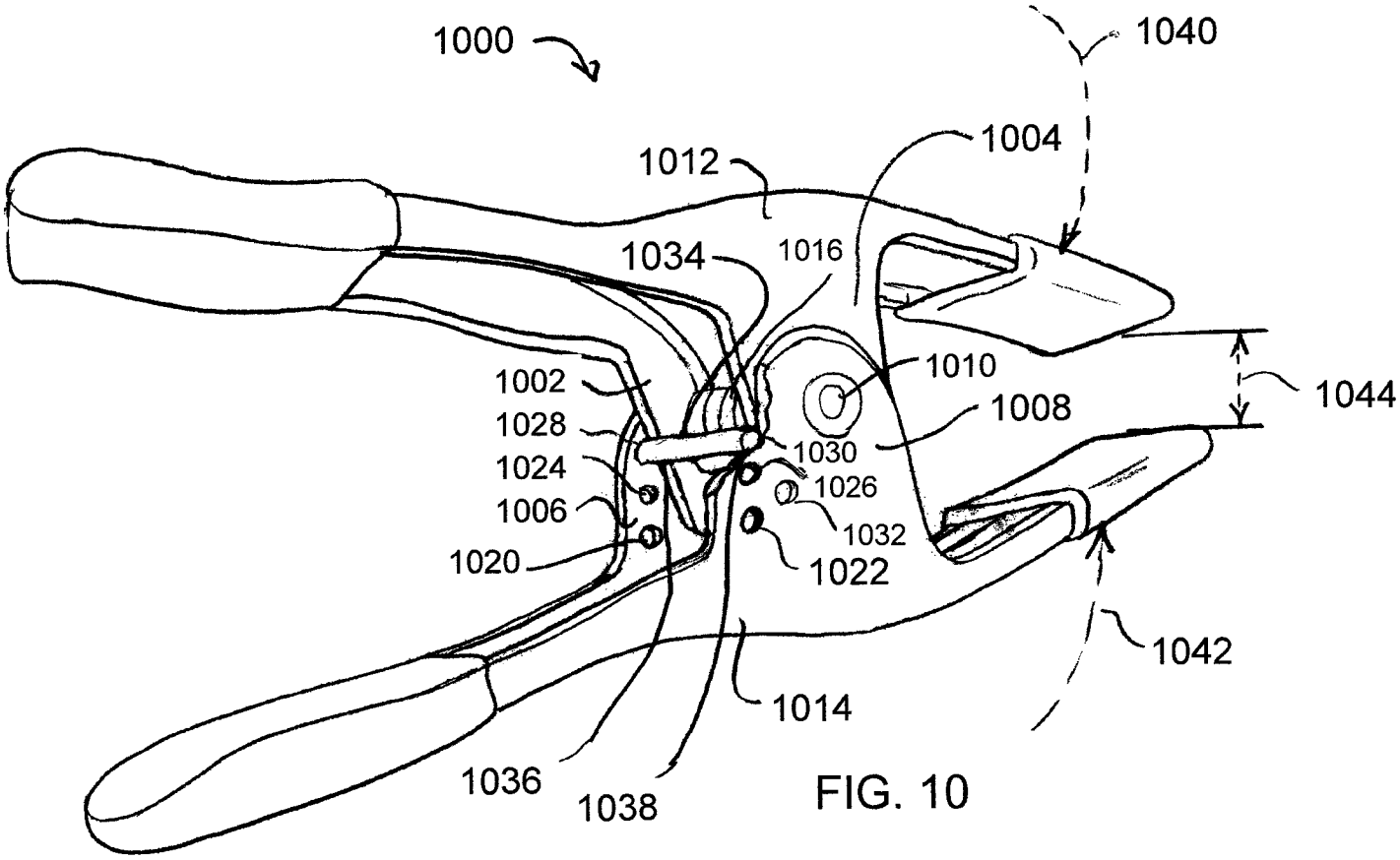
FIG. 10 illustrates a further spring clamp prepared according to principles of the invention.

FIG. 10 shows, in cutaway perspective view, one such improved spring clamp 1000. As illustrated, the spring clamp 1000 includes first 1002 and second 1004 upper flange portions as well as first 1006 and second 1008 lower flange portions. The four flange portions each includes a respective fulcrum through hole. The fulcrum through holes are mutually aligned, and a fulcrum shaft 1010 is disposed therethrough. The fulcrum shaft 1010 forms a pivotal coupling between an upper portion 1012 and a lower portion 1014 of the spring clamp 1000, and supports a generally helical spring clamp spring 1016 as previously described.

According to the present embodiment, one pair of flanges, here shown arbitrarily as the lower flanges 1006, 1008 include at least one pair of respective holes therethrough, e.g., 1020, 1022. The holes 1020, 1022 are substantially coaxially aligned and in spaced relation to one another. Thus holes 1020, 1022 form one pair of aligned holes, holes 1024 and 1026 form another pair of aligned holes. Holes 1028 and 1030 (cutaway) form a further pair of aligned holes, and hole 1032 is one of a still further pair of aligned holes, the second not being visible in the present illustration.

As will be apparent in light of the present illustration, respective portions of a shaft or pin 1034 will be disposed (either during manufacturing or by a subsequent user) within a pair of holes. In the present illustration, shaft 1034 is disposed within holes 1028 and 1030. The shaft or pin 1034 has external surface regions 1036, 1038 which are thereby arranged to mechanically interfere with corresponding edge surface regions of flanges 1002 and 1004. This interference will limit a range of rotation 1040, 1042 of the spring clamp jaws, and thus define a minimum spacing 1044 between the jaws. One of skill in the art will understand that the pin or shaft will include, in various embodiments and applications, one or more of a roll pin, a cotter pin, a machine screw, a rivet, or any other appropriate retaining feature.

The reader will appreciate that, in certain embodiments, when no shaft 1034 is employed the jaws will close fully (i.e., minimum dimension 1044 will be zero). Otherwise, the minimum dimension 1044 will be determined by which pair of holes the shaft 1034 is disposed within. Thus, a user can install, remove, and reinstall the pin or shaft 1034, thereby adjusting the minimum dimension 1044, according to the requirements of a particular task or manufacturing process.

Figures 11A, 11B:
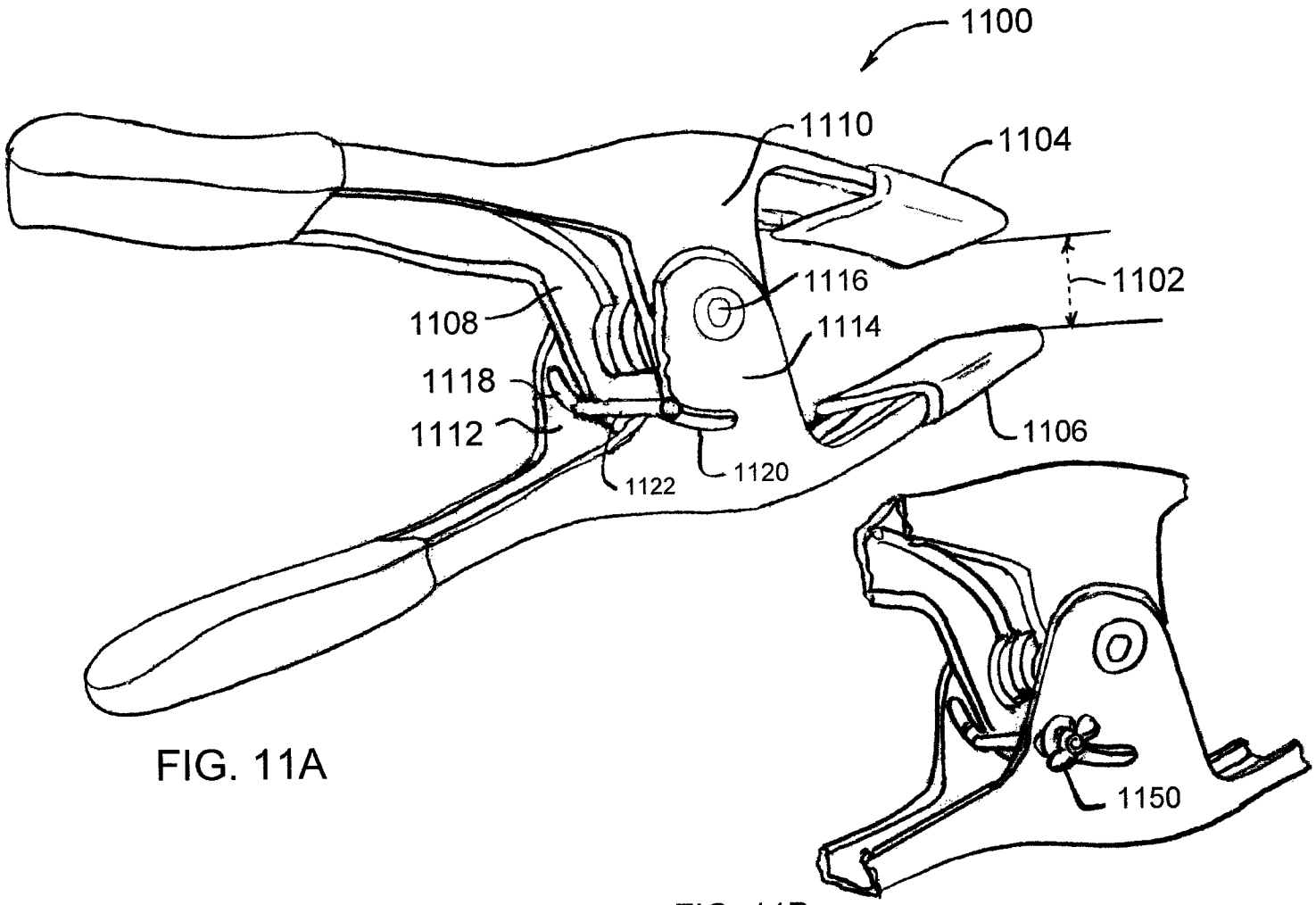
FIGS. 11A and 11B illustrate a further spring clamp prepared according to principles of the invention including fastener details.

FIGS. 11A and 11B show a further exemplary spring clamp 1100 prepared according to principles of the invention. Like spring clamp 1000, spring clamp 1100 includes a built-in feature provided to adjustably limit a minimum dimension 1102 between jaws 1104 and 1106. Accordingly, spring clamp 1100 includes first 1108 and second 1110 upper flanges and first 1112 and second 1114 lower flanges. The flanges are mutually pivotally coupled by a fulcrum shaft 1116. The lower, or the upper, flanges (here the lower flanges 1112, 1114) each incorporates a respective slot 1118, 1120. A pin or shaft 1122 is sliding the disposed within and between the slots 1118, 1120. The pin or shaft 1122 includes respective peripheral surface regions which are arranged to interfere with corresponding edge surface regions of the opposite flanges 1108, 1110. The pin or shaft 1122 further includes a detent mechanism (not shown) which is effective to adjustably fix the shaft 1122 at a particular location within the slots 1118, 1120. In certain exemplary embodiments, the detent mechanism will include one or more threaded regions, such that a nut can be placed on one end of the pin or shaft 1122 and the other end of the pin or shaft will include a further nut or a head. Merely for purposes of example, and without intending to limit the present disclosure, the nut may be a wingnut 1150 or a knurled nut.

By rotation of the nut, the shaft will be placed in tension between flanges 1112 and 1114 and thus fixed at a particular location within slots 1118, 1120 and with respect to the flanges 112, 114. Once the pin or shaft 1122 is fixed within the slots 1118, 1120, interference between the external surface regions of the shaft and the edge surface regions of the upper flanges will determine a minimum length of dimension 1102.

Figure 12A:
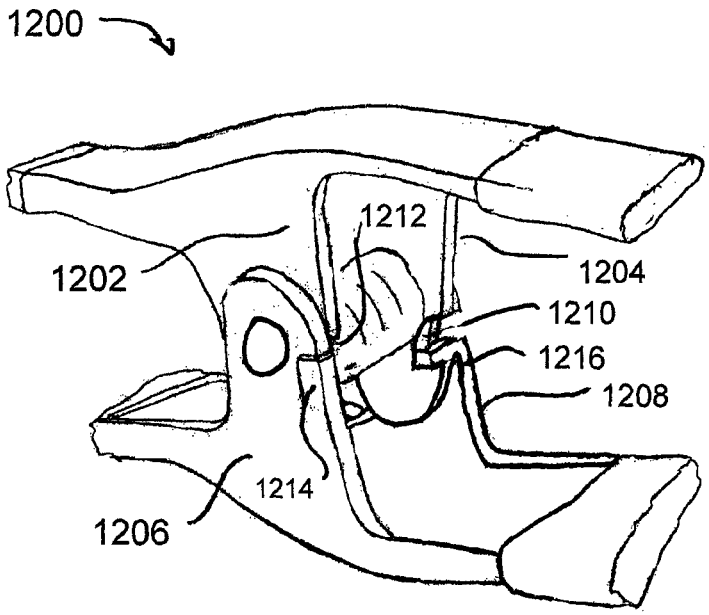
FIGS. 12A-12B illustrate certain features and methods of operation for a further exemplary spring clamp prepared according to principles of the invention.
Figure 12B:
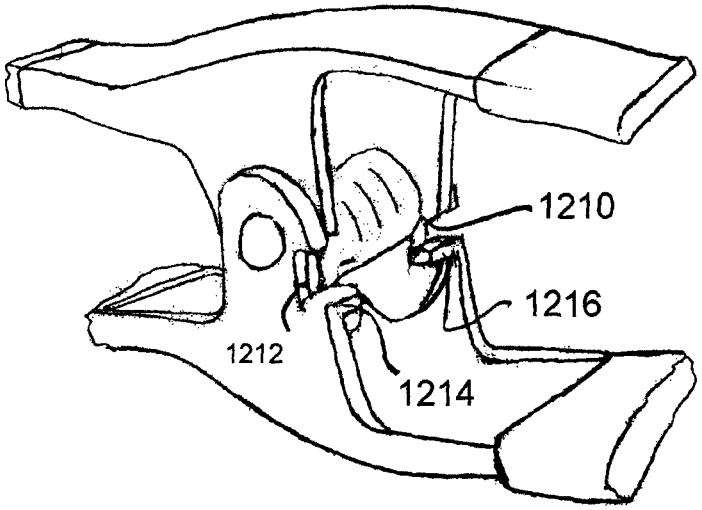

FIG. 12A shows, in schematic perspective view, another exemplary embodiment of a spring clamp 1200 prepared according to principles of the invention. Illustrated are a first upper flange 1202 and a second upper flange 1204 as well as a first lower flange 1206 and a second lower flange 1208. Upper flanges 1202 and 1204 include respective notches 1210, 1212. Lower flanges 1206, 1208 include respective malleable tabs 1214, 1216. In the illustrated spring clamp 1200, tab 1216 has been bent into position, either during manufacturing or by a subsequent action of a user, so as to be disposed within notch 1210. Tab 1214 is not bent. The tab 1214 is defined, however, by a slot, a perforation, or other appropriate feature, so as to allow subsequent bending into a position corresponding to that of tab 1216. Accordingly, in FIG. 12B, both tabs 1214 and 1216 are bent so as to be disposed within respective notches 1210 and 1212. It will be appreciated that, while notches 1210 and notches 1212 are shown as substantially aligned in the illustrated example, in other examples, these notches will be offset so as to allow alternative configurations of a spring clamp depending on which of one or more tabs is bent into the active position.

In view of the present illustration, one of skill in the art will readily appreciate that an interference relationship between surface regions of the tabs and the respective slots will tend to limit a minimum approach distance between jaws (not shown) of the spring clamp 1200. It will also be appreciated that the slots and tabs may be disposed respectively on upper and lower flanges, and either proximal or distal (or both) to the jaws of the spring clamp. A particular spring clamp embodiment may include a single tab and slot combination, or multiple tab and slot combinations. Also, the tabs may be exclusively formed during manufacturing of the spring clamp, or may be arranged for ready folding by a user, either with or without an appropriate tool. In any event, it will be appreciated that, like the various other examples provided above, these features will tend to limit a minimum closure of the spring clamp jaws and thus accord the benefit described above.

While the exemplary embodiments described above have been chosen primarily from the field of woodworking, one of skill in the art will appreciate that the principles of the invention are equally well applied, and that the benefits of the present invention are equally well realized in a wide variety of other manufacturing systems including, for example, metalworking, plastic fabrication, electronics assembly, etc. Further, while the invention has been described in detail in connection with the presently preferred embodiments, it should be readily understood that the invention is not limited to such described embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. An assembly clamp comprising:

a first lever portion including a first jaw;

a second lever portion including a second jaw;

a fulcrum member disposed in substantially fixed mutually pivotal coupling relation to said first and second lever portions;

a spring disposed between said first lever portion and said second lever portion and arranged to urge said first jaw towards said second jaw; and a retainer, said retainer including a first interference surface region adapted to operatively support said first jaw and a second interference surface region adapted to operatively support said second jaw, and said first and second interference regions being disposed in spaced relation to one another such that an intervening portion of said retainer provides a structural support between said first surface region and said second surface region, whereby said retainer operates to limit a minimum distance between said first and second jaws.

2. An assembly clamp as defined in claim 1 wherein said retainer further comprises a clip, said clip including an internal surface region disposed adjacent to an external surface region of said spring, said clip serving to position said interference surface regions of said retainer between said first and second jaws.

3. An assembly clamp as defined in claim 2 wherein said retainer clip comprises an integral feature of said intervening portion of said retainer.

4. An assembly clamp as defined in claim 2 wherein said retainer clip comprises a discrete clip element substantially permanently coupled to said intervening portion of said retainer.

5. An assembly clamp as defined in claim 1 wherein said first interference surface region comprises an external surface region of an adjusting member of said retainer.

6. An assembly clamp as defined in claim 5 wherein said adjusting member of said retainer further comprises a helically threaded surface feature.

7. An assembly clamp as defined in claim 1 wherein said retainer comprises a body member, said body member including an elastomeric material.

8. An assembly clamp as defined in claim 7 wherein said elastomeric material comprises a polyurethane material.

9. An assembly clamp as defined in claim 1 wherein said body member comprises a malleable metallic member.

10. An assembly clamp as defined in claim 1 wherein said retainer comprises an insertable pin.

11. An assembly clamp as defined in claim 1 wherein said retainer comprises a magnet coupler device.

12. An assembly clamp as defined in claim 1 wherein said retainer is removable and replaceable with a second retainer, wherein said retainer and said second retainer comprise elements of a kit of retainers.

13. An assembly clamp comprising:

a first lever portion including a first jaw and a first flange portion;

a second lever portion including a second jaw and a second flange portion;

a fulcrum member disposed in substantially fixed mutually pivotal coupling relation to said first and second lever portions;

a spring disposed between said first lever portion and said second lever portion and arranged to urge said first jaw towards said second jaw; wherein said first flange portion includes a foldable retainer tab, said foldable retainer tab having an interference surface region, said foldable retainer tab, when disposed in a folded configuration, being arranged to interfere with a surface region of said second flange portion and thereby to limit a minimum distance between said first and second jaws.

14. A method of clamping a workpiece comprising:

providing a spring clamp including a first lever portion having a first jaw and a first handle region, and a second lever portion having a second jaw and a second handle region;

inserting a retainer between said first lever portion and said second lever portion between a pivot of said spring clamp and said first and second handle regions respectively;

limiting a first non-zero minimum distance between said first jaw and said second jaw by a mechanical interference between said retainer, said first lever portion and said second lever portion;

urging a first handle region of said first lever portion toward a second handle region of said second lever portion so as to increase a distance between said first jaw and said second jaw to a second distance larger than said first distance; and releasing said first handle region and said second handle region, whereby said workpiece is substantially retained in substantially fixed spatial relation to said spring clamp by convergent forces of said first jaw and said second jaw against said workpiece.

15. A method of clamping a workpiece as defined in claim 14 wherein said inserting a retainer between said first lever portion of said spring clamp and said second lever portion of said spring clamp comprises disposing an insertion pin between respective interference surfaces of said first lever portion of said spring clamp and said second lever portion of said spring clamp.

16. A method of clamping a workpiece as defined in claim 15 wherein at least one of said respective interference surfaces comprises an internal surface region of a generally arcuate slot feature of a respective one of said first lever portion and said second lever portion.

17. A method of clamping a workpiece as defined in claim 15 wherein said disposing an insertion pin between said respective interference surfaces of said first lever portion of said spring clamp and said second lever portion of said spring clamp comprises applying a wingnut to one end of said insertion pin.

18. A method of clamping a workpiece as defined in claim 14 wherein said inserting a retainer between said first lever portion of said spring clamp and said second lever portion of said spring clamp comprises folding a malleable tab of said first lever portion into an orientation generally parallel to an interference surface region of said second lever portion.

19. An assembly clamp comprising:

a first lever portion including a first jaw;

a second lever portion including a second jaw;

a fulcrum member disposed in substantially fixed mutually pivotal coupling relation to said first and second lever portions;

a spring disposed between said first lever portion and said second lever portion and arranged to urge said first jaw towards said second jaw; and a retainer, said retainer including a first interference surface region adapted to operatively support said first jaw and a second interference surface region adapted to operatively support said second jaw, and said first and second interference regions being disposed in spaced relation to one another such that an intervening portion of said retainer provides a structural support between said first surface region and said second surface region, whereby said retainer operates to limit a non-zero minimum open distance between said first and second jaws.

* * * * *